United States Patent [19]

Vidwans

[11] 4,304,496

[45] Dec. 8, 1981

[54] RIBBON GUIDING AND RE-INKING MEANS FOR DATA PRINTERS AND THE LIKE

[75] Inventor: Mohan P. Vidwans, Saline, Mich.

[73] Assignee: Sycor, Inc., Ann Arbor, Mich.

[21] Appl. No.: 25,896

[22] Filed: Apr. 2, 1979

[51] Int. Cl.[3] ..... B41J 32/02; B41J 27/10

[52] U.S. Cl. ..... 400/195; 400/202; 400/248

[58] Field of Search ..... 400/194, 195, 196, 196.1, 400/202, 248

[56] References Cited

U.S. PATENT DOCUMENTS

| | | | |
|---|---|---|---|
| 2,475,336 | 7/1949 | Petz | 400/194 |
| 3,758,012 | 9/1973 | Bunner et al. | 400/195 |
| 3,897,866 | 8/1975 | Mueller | 400/196.1 |
| 3,904,018 | 9/1975 | Denley | 400/196 |

FOREIGN PATENT DOCUMENTS

| | | | |
|---|---|---|---|
| 2517824 | 11/1975 | Fed. Rep. of Germany | 400/196 |

*Primary Examiner*—S. Leon Bashore
*Assistant Examiner*—Steve Alvo
*Attorney, Agent, or Firm*—Price, Heneveld, Huizenga & Cooper

[57] ABSTRACT

A printing ribbon guiding and re-inking means is positioned to guide a continuous looped printing ribbon through a 180° twist between the exit and entry points of a ribbon cartridge. The guiding and re-inking means includes a twist-locator or arrestor comprising a pair of opposing elongated flanges, for passing a ribbon therebetween, positioned between the exit and entry points of the ribbon cartridge to positively locate the twist in the ribbon in a particular area along its path of travel. This prevents movement of the twist into other areas and other ribbon-carrying mechanisms, where the twist could cause jamming or undesirable ribbon twisting. A spool support means integrally coupled to the flanges carries a re-inking spool which both applies ink to the ribbon and guides the ribbon between the flanges and the cartridge. The spool orients the transverse position of the ribbon to be substantially the same as the transverse position of the ribbon at the entry to the cartridge. The opposing flanges orient the ribbon so it is rotated 90° in a direction transverse to movement with respect to the orientation of the ribbon at the entry to the cartridge.

4 Claims, 4 Drawing Figures

RIBBON GUIDING AND RE-INKING MEANS FOR DATA PRINTERS AND THE LIKE

BACKGROUND OF THE INVENTION

This invention relates generally to print heads for data printers or the like and, more particularly, to means for guiding and transporting inked printing ribbons used in such a printing head.

Heretofore it has been conventional to use a laterally-reciprocal printing head having a continuous-loop ribbon cartridge for supplying inked printing ribbon such that the ribbon passes before the printing needles which impact the ribbon to form characters on a printing surface. It is known that providing a 180° twist in a continuous loop-type printing ribbon (i.e., a "Mobius Loop") permits the printing needles or other impact members to strike different portions of the printing ribbon on different passes including both sides of the ribbon. However, the existence of the twist, although desirable for evening out ribbon wear and, consequently, providing for longer ribbon life and improved printing characteristics, can cause jamming problems as the speed of ribbon advance changes and the tension on the ribbon varies, since the twist can become fixed in the ribbon as a fold which travels with the ribbon as the latter is advanced. When this occurs, the least that can happen is that the ribbon no longer is reversed from one side to the other as it is moved along its entire length, and the favorable wear-extending effects of reversal are thus lost. More often, the moving fold representing the twist appears as a thickened, bunched section of ribbon which will snag, catch or jam at some point along the path of ribbon travel, most often breaking or tearing the ribbon or jamming the ribbon transport mechanism and causing not only shutdown of the printer but serious problems or breakage of parts as well. These are some of the problems this invention overcomes.

SUMMARY OF THE INVENTION

This invention recognizes that it is desirable to establish a particular consistent position for, i.e., positively fix the location of, the twist in a printing ribbon on a printing head. Further, one embodiment of the invention recognizes that the location of the twist can be fixed by a pair of opposing, spaced flanges sufficiently elongated in a direction transverse to ribbon movement to guide the ribbon and, advantageously, to extend beyond the edges of the printing ribbon. The longitudinal direction of the opposing flanges can be rotated, for example, about 90° from the direction of the transverse axis of the ribbon when supported within the cartridge for a continuous ribbon loop. Advantageously, an embodiment of this invention can include spool support means holding a spool for guiding and re-inking the ribbon. The axis of the spool support means is aligned with the transverse direction of the ribbon as it enters or exits the cartridge. The spool support means can be integral with the flanges and positioned to guide the ribbon between the opposing flanges and the cartridge.

This invention provides a simple, integral means locating and maintaining the position of the twist in the ribbon, and for re-inking the ribbon, thereby improving mechanical performance and prolonging ribbon life. In particular, printing speed is enhanced by providing more positive control over ribbon movement and reducing printer down time by reducing ribbon jamming and malfunction.

DETAILED DESCRIPTION OF THE INVENTION

Figure 1:
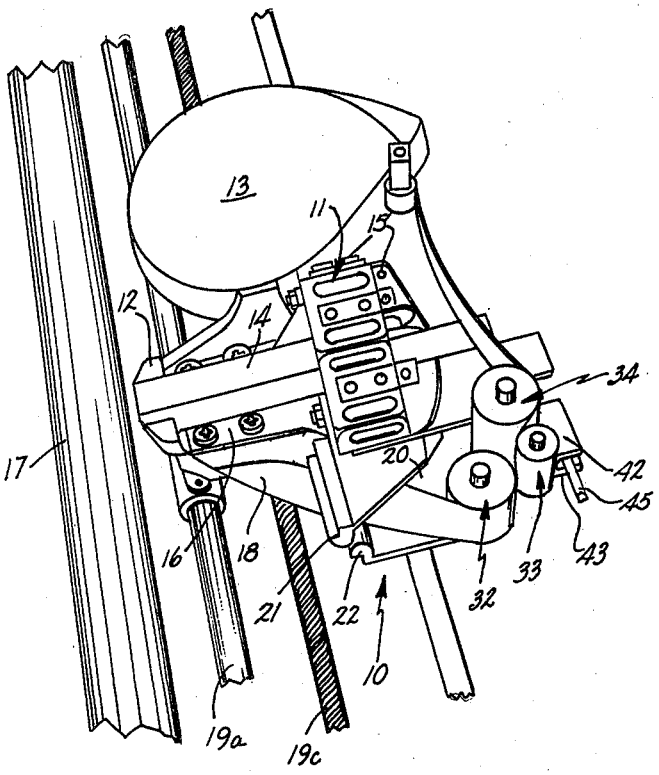
FIG. 1 is a front perspective view of a ribbon guiding and re-inking means with two re-inking spools and an idler spool, in accordance with an embodiment of this invention, carried on an exemplary type of print head having a ribbon cartridge and positioned adjacent a platen.

Referring to FIG. 1, a ribbon guiding and re-inking means 10 is mounted on an illustrative dot matrix impact-type print head 11 having a front ribbon guide 12 at the impact or printing point, a ribbon cartridge 13, a print stylus guide cover 14, a stylus driver assembly 15 (e.g., a solenoid cluster) and a supporting frame 16. Print head 11 is movably mounted upon guide rods **19*a*, 19*b* and engaged to be laterally driven by a lead screw 19*c* adjacent a platen 17 which supports a printing surface such as paper or printed forms, (not shown) which receive printed impressions from print styli of print head 11 striking an inked ribbon 18 supported by front guide 12 between print head 11 and platen 17**.

Figure 4:
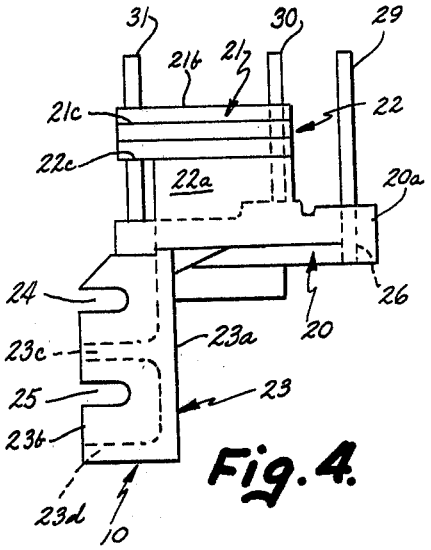
FIG. 4 is a front elevation view of a ribbon guiding and re-inking means in accordance with an embodiment of this invention without the re-inking and idler spools shown in FIG. 3.
Figure 3:
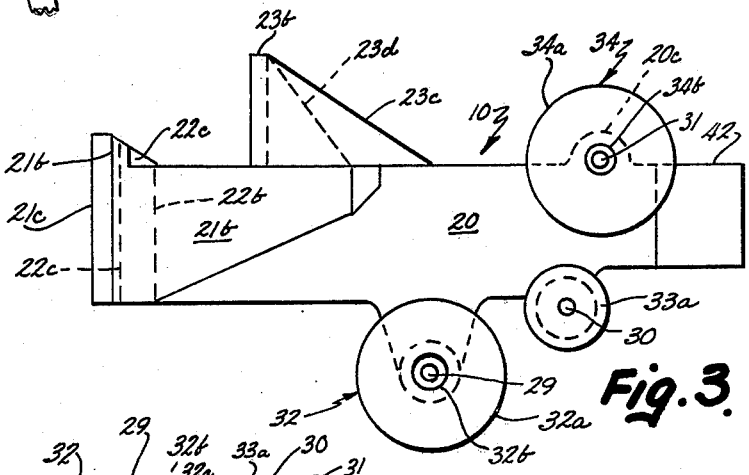
FIG. 3 is a top plan view of a ribbon guiding and re-inking means with two re-inking spools and an idler spool in accordance with an embodiment of this invention.
Figure 2:
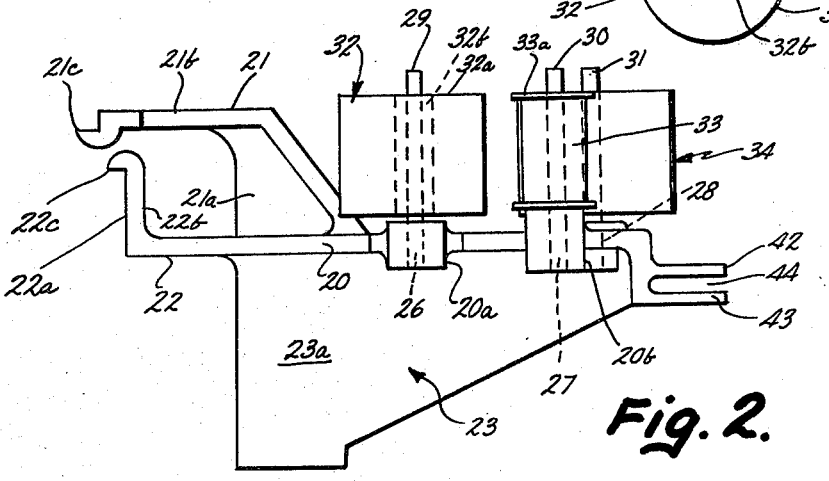
FIG. 2 is a side elevation view of a ribbon guiding and re-inking means in accordance with an embodiment of this invention and including one re-inking spool and an idler spool.

Referring to FIGS. 2, 3 and 4, ribbon guiding and re-inking means 10 has a main body 20 of a generally elongated rectangular shape with its longitudinal axis parallel to the longitudinal axis of guide cover 14. At the front or platen end of main body 20 are a pair of horizontal opposing guide means 21, 22 for passing ribbon 18 therebetween. More particularly, an upper flange 21 and a lower flange 22 extend from main body 20 and define a horizontally oriented space between the flanges (FIG. 2), through which the ribbon passes. Upper flange 21 includes a sidewall **21*a* (see FIG. 2) extending upward from main body 20 and facing the print head frame 16, leading to a cantilevered extension 21*b* extending over main body 20 and terminating at the platen end in a downwardly-extending rounded lip 21*c*. The length of lip 21*c* in the direction transverse to main body 20 (FIG. 3) is longer than the width of extension 21*b*. As a result, full width upper support for ribbon 18 is provided by lip 21*c* without unnecessary use of materials in extension 21*b*. Lower flange 22 includes a wall 22*a* (FIGS. 2 and 4) extending upwardly from the platen end of main body 20 and terminating an elongated upwardly-extending lip 22*c*, generally parallel to lip 21*c*, for providing lower support for ribbon 18. Upper lip 22*c* is displaced rearward with respect to lower lip 21*c* (FIG. 2) so there can be essentially zero vertical displacement and a small horizontal displacement between the opposing extremities of lips 21*c* and 22*c* (FIG. 2). Lips 21*c* and 22*c* are elongated in a direction perpendicular to ribbon movement and have curved surfaces opposing one another, with the radii of the curved surfaces aligned with the direction of ribbon movement for providing a smooth guide for ribbon 18**.

A mounting support 23 (FIGS. 2 and 4) extends downward from the central portion of main body 20. Mounting support 23 is a right-angle section, including a generally-vertical wall 23*a* having a perpendicular flange 23*b* (FIG. 4) extending outwardly from the forwardmost vertical edge of wall 23*a*. Flange 23*b* includes two horizontal notches 24 and 25 (FIG. 4), one above the other, opening toward frame 16. Typically, mounting means such as screws pass through notches 24 and 25 and secure the ribbon guiding and re-inking means 10 to frame 16. A pair of triangular-shaped, horizontally-extending, reinforcing ribs 23*c* and 23*d* (see FIGS. 3 and 4) extend between flange 23*b* and wall 23*a*, one below notch 24 and one below notch 25, respectively.

Main body 20 defines three integral hub portions or bosses, 20*a*, 20*b* and 20*c* (FIGS. 2 and 3) each having a vertical cylindrical opening 26, 27 and 28 extending through main body 20, for receiving elongated, cylindrical steel pins 29, 30 and 31, respectively, which form axes upon which are mounted rotary members 32, 33 and 34, respectively. Of these members 32 and 34 are re-inking rollers having resilient cylindrical foam bodies, 32*a* and 34*a* respectively, with axial support tubes, 32*b* and 34*b* respectively, of a structurally-supportive material, such as rigid or semi-rigid plastic, for rotatably receiving axle pins 29 and 31, respectively (see FIGS. 2 and 3). If desired, support tubes 32*b* and 34*b* can extend upwardly above foam bodies 32*a* and 34*a*, respectively, to provide a grip for removing the spools from the pins. Advantageously, such a grip has a notched exterior to facilitate grasping and turning. Rotary member 33 is an idler spool, positioned between re-inking rollers 32 and 34 for increasing the area of contact between the ribbon 18 and rollers 32 and 34 (i.e., wraparound). Preferably, idler spool 33 has end flanges 33*a* and 33*b* (FIG. 2) whose diameter is somewhat greater than that of the spool body disposed therebetween, so as to extend horizontally over and under the inked ribbon and thereby support the same vertically. As shown in FIG. 1, ribbon 18 is wound around the outside and rear portion of roller 32, around the front of spool 33, and around the rear portion of roller 34. A typical preferred material for re-inking spools 32 and 34 is a foam which can carry (i.e., absorb) a quantity of ink. Idler spool 33 is preferably a relatively smooth structural material such as rigid or semi-rigid plastic. The main body 20 and associated parts of the ribbon guiding and re-inking means is a plastic which can be injection molded, such as that known by the trademark "Lexan 500".

In accordance with the particular embodiment under discussion, the ribbon guiding and re-inking means further includes a pair of vertically-spaced, integral flanges 42 and 43 (FIG. 2) extending rearward from main body 20. These flanges define a horizontal, rearwardly-opening slot 44 therebetween, which receives a control cable 45 (FIG. 1) coupled to print head 11. As print head 11 moves along platen 17, flanges 42 and 43 guide cable 45 and prevent it from tangling.

OPERATION

Ribbon guiding and re-inking means 10 is secured to print head 11, as by attachment to its frame 16, preferably on the side of the print head which is opposite from ribbon cartridge 13. More specifically, mounting screws pass through notches 24 and 25 to secure flanges 23*b* to frame 16. Ribbon 18 is threaded through front guide 12, where it is vertically disposed, and then between the upper and lower horizontal flanges 21 and 22, where the ribbon is horizontally disposed. The twist in ribbon 18 between front guide 12 and flanges 21 and 22 is continued in the same direction until the ribbon has been turned 180°, i.e., the ribbon is twisted or rotated 90° between front guide 12 and flanges 21 and 22, and rotated 90° further between flanges 21 and 22 and spool 32. After such a twist or rotation of ribbon 18, ribbon 18 is passed around spools 32, 33 and 34 as described above and then returned to ribbon cartridge 13. As a result, the ribbon 18 entering cartridge 13 has been turned 180° from the ribbon leaving cartridge 13. Thus, ribbon wear is equalized between the top and the bottom of the ribbon, and on both sides thereof.

The horizontal guide flanges 21 and 22 serve to position, and retain, the twist in ribbon 18 at the location of lips 21*c* and 22*c*. Accordingly, the twist in the ribbon cannot readily move toward, and into, either front guide 12 or spools 32–34 and cartridge 13, where the twist would likely cause jamming, and potential breakage.

Various modifications and variations of this invention may well occur to those skilled in the art after studying the foregoing disclosure. For example, the particular shape and nature of certain of the elements may be varied from that specifically disclosed herein. Also, the ribbon guiding and re-inking means can be mounted in various different ways from that disclosed herein. These and all other such variations which are based upon the concepts disclosed herein and incorporate the underlying spirit of the invention are properly considered within the scope of the invention, as defined by the appended claims.

The embodiments of the invention in which an exclusive property or privilege is claimed are defined as follows:

1. A printing ribbon guiding and re-inking apparatus comprising:

a pair of opposing, elongated, generally parallel flange portions defining an elongated opening therebetween for receiving and orienting a printing ribbon entrained therethrough; said flange portions being mounted for movement as a unit with a print head having a continuous loop-type ribbon; said ribbon being entrained lengthwise through said flange portions in a manner such that a ribbon twist results, thereby inverting said ribbon from a point upstream of the flange portions to a point downstream thereof;

roller support means integrally attached to said flange portions, for carrying re-inking means, said roller support means being located adjacent the path of the ribbon downstream from said flange portions in the direction of ribbon travel;

re-inking roller means having a generally cylindrical shape mounted on said roller support means, said ribbon contacting a portion of the perimeter of said roller means; and said re-inking roller means comprising a first re-inking roller, a second re-inking roller, and an idler member positioned between said first and second rollers for partially wrapping the ribbon around a portion of the periphery of said first and second rollers; said first and second rollers having at least surface portions made of a material suitable for carrying ink.

2. A printing ribbon guiding and re-inking apparatus as recited in claim 1 wherein said pair of opposing elongated flange portions have ribbon-guiding surfaces which are offset from one another along the direction of travel of the ribbon, said ribbon guiding surfaces being disposed in substantially the same plane.

3. The printing ribbon guiding and re-inking apparatus according to claim 1, wherein a portion of said inking ribbon is disposed externally of a ribbon cartridge which contains the remainder of the inking ribbon, said ribbon being in the form of a continuous loop;

wherein said generally parallel flange portions comprise a pair of opposing guides disposed outside of said cartridge and along said portion of said ribbon external of said cartridge, said guides being sufficiently spaced apart to pass a ribbon therebetween and being sufficiently longitudinally elongated in a direction generally transverse to ribbon movement to extend substantially across the width of the printing ribbon;

and wherein said roller support means is disposed outside said cartridge along said external portion of the ribbon, said roller support means having a support axis disposed generally perpendicular to the plane of the guides; and said ribbon being entrained about the periphery of said re-inking roller an extent sufficient to change the longitudinal axis of motion of the ribbon and to rotate the roller while passing around the same during ribbon movement.

4. The printing ribbon guiding and re-inking apparatus according to claim 1, wherein a first portion of said ribbon is contained within a ribbon cartridge and a second portion of said ribbon is disposed externally of the cartridge; said external second portion of ribbon defining an open loop leading out of the ribbon cartridge, extending across a print head, and leading back into the ribbon cartridge, said external loop of ribbon being disposed generally in the same plane as said ribbon cartridge, and the ribbon in said external loop defining an axial twist of about 180°, and wherein said generally parallel and laterally elongated opposing flange portions are disposed generally at the same level and generally in the same plane as the ribbon and the cartridge, and are oriented to extend across the path of the external loop of ribbon at an oblique angle with respect thereto, said flange portions being mutually spaced apart from one another and said ribbon in said external loop being entrained to pass between said flange portions and thereby undergo said axial twist of about 180° as the ribbon travels on its path relative to the print head and the printing surface, out of and back into the ribbon cartridge.

* * * * *